US008984916B2

(12) United States Patent
Siewers

(10) Patent No.: US 8,984,916 B2
(45) Date of Patent: Mar. 24, 2015

(54) SYSTEM AND METHOD FOR WASHING ARTICLES EMPLOYING A DENSIFIED CLEANING SOLUTION, AND USE OF A FLUID DISPLACEMENT DEVICE THEREIN

(75) Inventor: Ernst-Jan Siewers, Alkmaar (NL)

(73) Assignee: CO2Nexus, Inc., Denver, CO (US)

( * ) Notice: Subject to any disclaimer, the term of this patent is extended or adjusted under 35 U.S.C. 154(b) by 258 days.

(21) Appl. No.: 13/520,649

(22) PCT Filed: Dec. 17, 2010

(86) PCT No.: PCT/NL2010/050859

§ 371 (c)(1),
(2), (4) Date: Aug. 13, 2012

(87) PCT Pub. No.: WO2011/084050

PCT Pub. Date: Jul. 14, 2011

(65) Prior Publication Data

US 2012/0304401 A1 Dec. 6, 2012

Related U.S. Application Data

(60) Provisional application No. 61/292,257, filed on Jan. 5, 2010.

(51) Int. Cl.

| | |
|---|---|
| ***D06F 43/00*** | (2006.01) |
| ***D06F 43/08*** | (2006.01) |
| *B08B 7/00* | (2006.01) |

(52) U.S. Cl.

CPC ..... *D06F 43/081* (2013.01); *D06F 43/00* (2013.01); *B08B 7/0021* (2013.01); *D06F 43/08* (2013.01)

USPC ..... 68/18 R

(58) Field of Classification Search

CPC ..... D06F 43/00; D06F 43/02; D06F 43/08; D06F 43/081; D06F 43/083; B08B 7/0021; F04B 2015/0818

USPC ..... 68/18 R

See application file for complete search history.

(56) References Cited

U.S. PATENT DOCUMENTS

| | | | | |
|---|---|---|---|---|
| 5,064,354 | A * | 11/1991 | Robertson et al. | 417/403 |
| 5,267,455 | A | 12/1993 | Dewees et al. | |
| 6,082,150 | A * | 7/2000 | Stucker | 68/18 R |
| 2002/0189026 | A1 * | 12/2002 | McClain et al. | 8/158 |

FOREIGN PATENT DOCUMENTS

| | | |
|---|---|---|
| EP | 0919659 | 6/1999 |
| WO | 98/46819 | 10/1998 |
| WO | 99/13148 | 3/1999 |

OTHER PUBLICATIONS

International Search Report dated Mar. 30, 2011, in corresponding PCT application.

* cited by examiner

*Primary Examiner* — Michael Barr
*Assistant Examiner* — Spencer Bell
(74) *Attorney, Agent, or Firm* — Martensen IP

(57) ABSTRACT

A dry cleaning system arranged for washing articles employing a cleaning solution. The dry cleaning system includes a wash tank (2) for washing an article to be washed with a cleaning solution. The wash tank (2) is arranged for washing the article at an increased pressure compared to atmospheric pressure. The dry cleaning system includes a fluid displacement device (1), such as a pump, connected to the wash tank (2) and is arranged for transferring the cleaning solution through the dry cleaning system in a first operational mode. The fluid displacement device is arranged to reduce the pressure in the wash tank towards atmospheric pressure in a second operational mode.

18 Claims, 2 Drawing Sheets

SYSTEM AND METHOD FOR WASHING ARTICLES EMPLOYING A DENSIFIED CLEANING SOLUTION, AND USE OF A FLUID DISPLACEMENT DEVICE THEREIN

FIELD OF THE INVENTION

The invention relates to systems and methods for conserving vapor and collecting liquid carbon dioxide for cleaning systems, more particularly to methods and systems for conserving vapor and collecting liquid carbon dioxide for carbon dioxide dry cleaning systems.

BACKGROUND OF THE INVENTION

Dry cleaning systems are known. Additionally, dry cleaning systems that use vapor and liquid carbon dioxide are known. The system employs a washing vessel, in which articles to be washed may be placed. Vapor and liquid carbon dioxide is transferred to the washing vessel. The carbon dioxide is pressurized inside the washing vessel. Pressures inside the vessel may be equal to approximately 700-900 psi. Liquid and vapor carbon dioxide is capable of cleaning the articles. Additives, such as organic solvents, may be supplemented. After washing, the washing vessel is depressurized. Liquid and vapor carbon dioxide are removed from the washing vessel. The clothes may be removed from the washing vessel, after which a new washing cycle may be initiated.

A drawback of the known systems and methods is loss of vapor carbon dioxide. Blow off of vapor carbon dioxide for depressurizing the washing vessel leads to losses of material. Additionally, in other parts of the systems, i.e. in piping systems and connections thereof, losses of carbon dioxide may occur. The loss of this carbon dioxide needs to be replenished in a new washing cycle.

Additionally, the losses of liquid and vapor carbon dioxide are associated with a relatively low thermodynamic efficiency.

SUMMARY OF THE INVENTION

It can therefore be an object of the present invention to provide systems and methods for minimizing the losses of carbon dioxide in a liquid carbon dioxide dry cleaning system.

It can be another object of the present invention to provide systems and methods for improving the thermodynamic efficiency of a liquid carbon dioxide dry cleaning systems.

It can be a further object of the present invention to provide systems and methods for lowering the capital costs associated with a liquid carbon dioxide dry cleaning system.

The present invention provides a dry cleaning system arranged for washing articles employing a cleaning solution. The system comprises a wash tank for washing an article to be washed with a cleaning solution. The wash tank may be arranged for washing the article at an increased pressure compared to atmospheric pressure (hyperatmospheric pressure). The system may comprise a fluid displacement device, such as a pump, connected to the wash tank and arranged for transferring the cleaning solution through the dry cleaning system in a first operational mode. According to the invention, the fluid displacement device may be used to reduce the pressure in the wash tank towards atmospheric pressure in a second operational mode. Instead of blowing off the contents of the wash tank, these contents are kept in the dry cleaning system. Loss of material is thus prevented. Additionally, loss of heat is prevented. The fluid displacement device, being arranged for both transferring cleaning solution, as well as depressurizing the wash tank, ensures that a relatively simple dry cleaning system having a minimal amount of components may be used. The complexity of the system is reduced. Connections between the components (e.g. fluid displacement device and wash tank) may be relatively simple. This reduces the losses of cleaning solution, and more specifically losses of carbon dioxide in the system, for instance losses that occur at connections in the system. The reduced complexity of the system also lowers capital costs.

The washing tank may be arranged for washing articles at a pressure of approximately 700-900 psi, for instance 715 psi or 875 psi. It should be noted however, that higher or lower pressures are thinkable. The cleaning solution may be a densified cleaning solution. The cleaning solution may comprise a vapor and a liquid, such as vapor and liquid carbon dioxide.

In an embodiment, the dry cleaning system may comprise a depressurization unit connected to the wash tank for reducing the pressure in the wash tank towards atmospheric pressure. The depressurization unit may be a valve. The depressurization unit, i.e. the fluid displacement device, may be used to accurately control the pressure inside the wash tank. Preferably, however, the depressurization unit is the fluid displacement device. The contents of the wash tank may be preserved in the dry cleaning system, preventing loss of material.

It is possible that the fluid displacement device is arranged for removing vapor from the wash tank in the second operational mode. After washing, liquid cleaning solution may be removed from the wash tank by means of the fluid displacement device operating in the first operational mode. Vapor cleaning solution will remain in the wash tank. Pressures inside the wash tank will still be elevated compared to atmospheric pressure. The fluid displacement device may be arranged for draining the contents, such as a vapor or a gas, e.g. vapor carbon dioxide, from the wash tank. With this, the pressure inside the wash tank may be reduced towards atmospheric pressure. The contents drained may be re-used in the system. With this, preservation of cleaning solution, e.g. carbon dioxide, may be exerted, minimizing losses of material, and additionally increasing thermodynamic efficiency.

In an embodiment, the fluid displacement device is arranged for compressing vapor removed from the wash tank. The pressure of the vapor removed may be brought to a desired level. For instance, the pressure may be increased to the working pressure of the system. With this, the vapor removed may be brought to a pressure suitable for use in the dry cleaning system, e.g. for use in a new washing cycle. This ensures that the pressure throughout the system, except for the wash tank, may be kept at a uniform level. Pressure losses in the system are reduced. With this, thermodynamic efficiency may be increased. In the wash tank, the pressure may be reduced such that articles that are washed may be removed from the wash tank. The fluid displacement device may be used as a compressor, and may increase the pressure of the vapor removed to approximately, for instance, 715 psi or 875 psi. Other pressures, such as higher or lower pressures, are, of course, also possible.

The fluid displacement device may be a pumping/compressing unit arranged for pumping and compressing the cleaning solution. In a first operating modus, the fluid displacement device may be used for pumping cleaning solution in liquid form throughout the system. In a second operating modus, the displacement device may be used for pumping cleaning solution in vapor form throughout the system. In the second operating modus, the fluid displacement device may additionally be used to increase the pressure of the vapor. The combination of two operating modes in one fluid displacement device may lead to lower capital costs.

In an embodiment, the fluid displacement device is a positive-displacement device. The positive-displacement device may be a reciprocating device or a piston device that uses one or more pistons driven by a crankshaft to pressurize fluid. The use of a positive-displacement device with one or more pistons enables the use of a single fluid displacement device for transferring fluids, such as liquids and vapors, as well as compressing fluids, and more particularly for compressing vapors.

In an embodiment, the fluid displacement device comprises an inlet connected to a pumping chamber, in which a piston is reciprocally movable. The pumping chamber may comprise a pumping chamber inlet opening connected to the inlet. The pumping chamber may also comprise a pumping chamber outlet opening connected to the outlet. The pumping chamber comprises a discharge unit connected to the pumping chamber outlet opening. The discharge unit is arranged for closing the pumping chamber outlet opening when a pressure inside the pumping chamber is less than a pre-set pressure. With this it is possible to compress vapor, and to transfer liquid. The fluid displacement device may thus act as a pumping/compressing unit.

The pumping chamber inlet opening may be provided near one end of the pumping chamber, and the pumping chamber outlet opening may be provided near an opposite end. This way, the piston may be used to close the pumping chamber inlet opening. There is no need for a complicated and expensive system for closing the pumping chamber inlet opening during a compression stroke of the fluid displacement device.

In an embodiment, the discharge unit is a spring-loaded valve. The discharge unit ensures that the fluid, such as a gas or a vapor, may be compressed in order to increase the pressure of the fluid. The fluid displacement device is able to function as a pumping/compressing unit, arranged for both pumping and compressing the cleaning solution.

It is possible that the fluid displacement device comprises additional pumping chambers connected to the inlet and the outlet. The pumping chamber comprises a pumping chamber inlet, a pumping chamber outlet, a piston. An additional discharge valves may be provided. The pumping chambers of the fluid displacement device are used for both pumping and compressing fluid. In other words, the pumping chambers have different functions, in different modi of the fluid displacement device. It is possible that the positive displacement device comprises at least three pumping chambers, connected to a single inlet, and connected to a single outlet. With this, the fluid displacement device may exert effective pumping and compressing.

The dry cleaning system may further comprise a central storage tank for storing the cleaning solution. The central storage tank enables storage of unused cleaning solution. The fluid displacement device may be used to transfer cleaning solution from the central storage tank, to the wash tank, and vice versa.

In an embodiment, the dry cleaning system may comprise a first piping system arranged for bringing the central storage tank into fluid communication with the wash tank. The first piping system may be used to transfer liquid carbon dioxide from the central storage tank to the wash tank. Transfer from the wash tank to the central storage may also be possible. Transfer may be exerted by the fluid displacement device. The fluid displacement device may function as a pump for the first piping system. The system may further comprise a second piping system arranged for bringing the wash tank into vapor communication with the central storage tank. The second piping system may be used to transfer vapor from the wash tank to the central storage tank. Transfer from the central storage tank to the wash tank may also be possible. The system may further comprise a common piping system formed by a coinciding part of the second piping system and the first piping system. This way, the common piping system may be used for separate transfer of both liquids, and vapors, enabling the fluid displacement device to work in two operating modes. Preferably, the fluid displacement device is residing in the common piping system. The common piping system improves thermal efficiency, since losses to the environment are minimized. Also, costs are decreased.

It is possible that the dry cleaning system comprises an intermediate storage tank for temporarily storing the cleaning solution. The intermediate storage tank may be connected to the wash tank. The fluid displacement device may be arranged for transferring the cleaning solution between the cleaning device and the wash tank. The intermediate storage tank allows for already used cleaning solution, which may be re-used again, to be stored for further use. The intermediate storage tank may be used for storing liquid cleaning solution. The intermediate storage tank may be connected to the first piping system. It is possible that used cleaning solution, which is dirty, is used again in the same or any further washing cycle. The intermediate storage ensures that this cleaning solution may be stored for further use, without affecting the cleaning solution in the central storage tank.

It is possible that the dry cleaning system comprises a cleaning device for cleaning the cleaning solution. The cleaning device may be connected to the wash tank. The fluid displacement device may be arranged for transferring the cleaning solution to the cleaning device. Already used cleaning solution may be cleaned using this device. The cleaning solution may, after having been cleaned, be transferred to the central storage tank. The cleaning device may be part of the common piping system, such that both vapor and liquid cleaning solution may be cleaned.

In an embodiment, the fluid displacement device is arranged for compressing vapor cleaning solution, and transferring compressed vapor to the cleaning device.

In an embodiment, the cleaning device is a distillation unit. The distillation unit may be used to distillate the used and relatively dirty cleaning solution. Distillation of the already used cleaning solution ensures that impurities are removed. Distillation is relatively simple. Distillation also has a relatively high efficiency. Distillation ensures that a relatively clean cleaning solution may be obtained, which cleaning solution may be re-used in a further washing cycle.

The system may further comprise a central storage tank for storing the cleaning solution. The central storage tank may be connected to the wash tank. The distillation unit may be connected to the central storage tank for returning cleaned cleaning solution to the central storage tank. The system may comprise a third piping system arranged for bringing the distillation unit into fluid connection with the central storage tank for returning relatively clean cleaning solution to the central storage tank. This way, used cleaning solution may be cleaned and transferred to the central storage tank, after which it may be used in a next washing cycle.

The system may comprise a cooling unit arranged for bringing the cleaned and returned cleaning solution into liquid form. The cooling unit may reside in the third piping system. Preferably, the cleaning solution is returned to the central storage tank in liquid form. During the distillation process, the cleaning solution will evaporate. The vapor cleaning solution may then be transferred through the third piping system, for instance under the influence of buoyancy forces, to the central storage tank. To bring the vapor into liquid form, the vapor may be cooled using the cooling unit.

Preferably, the cleaning solution comprises liquid carbon dioxide. The carbon dioxide, when used in a dry cleaning system, produces satisfactory results. As stated before, additives, such as organic or inorganic solvents, may be present in the cleaning solution.

In an embodiment, a purging unit is provided for cleaning the wash tank. The purging unit may be part of the dry cleaning system. The cleaning of the wash tank is preferably exerted before the start, or at the beginning of a new wash cycle. The purging unit may be arranged for removing nitrogen and oxygen from the wash tank.

The purging unit may comprise a purge tank for storing a purging fluid, wherein the purge tank may be brought into fluid communication with the wash tank, and wherein the purging fluid is arranged for cleaning the wash tank.

In an embodiment, the purging fluid is vapor carbon dioxide. The pressure of the purging fluid may be in between 72 and 230 psi. The purging fluid efficiently removes air, and more specifically nitrogen and oxygen, from the wash tank.

The dry cleaning system may comprise a central storage for storing vapor cleaning solution. The vapor cleaning solution may be vapor carbon dioxide. The central storage may be connected to the wash tank for transferring vapor cleaning solution to the wash tank. The dry cleaning system may further comprise a further piping system arranged for bringing the central storage tank into vapor communication with the wash tank. Preferably, the further piping system may be used to transfer vapor cleaning solution from the central storage tank to the wash tank.

In an embodiment, a central storage for both vapor and liquid cleaning solution is provided.

According to another aspect of the invention, a method for washing an article in a dry cleaning system employing a cleaning solution is provided. The cleaning solution may be a densified cleaning solution. The system comprises a wash tank for washing an article to be washed with the cleaning solution, and a fluid displacement device connected to the wash tank and arranged for transferring the cleaning solution. The method comprises the step of operating the fluid displacement device for transferring the cleaning solution in the dry cleaning system, and operating the same fluid displacement device for depressurizing the wash tank. The fluid displacement device may be used for transferring liquid cleaning solution throughout the dry cleaning system. Additionally, the same fluid displacement device may be used for depressurizing the wash tank after washing. Instead of blowing off the contents of the wash tank, the contents may be re-used. This way, loss of material is prevented. Furthermore, in the method only a single component is used for providing two functions to the dry cleaning system.

The step of operating the same fluid displacement device for depressurizing the wash tank may comprises the step of reducing the pressure in the wash tank towards atmospheric pressure. The pressure in the wash tank may be reduced from approximately 700-800 psi, to approximately 100-200 psi, in a relatively controlled manner. With this, pressure is reduced towards atmospheric pressure. Additionally, a further reduction to approximately 14.7 psi may be exerted.

The step of operating the same fluid displacement device for depressurizing the wash tank may comprise the step of removing vapor from the wash tank. In the wash tank, vapor cleaning solution, such as vapor carbon dioxide, may be present. The vapor may have a pressure of approximately 700-800 psi. Depressurizing of the wash tank may be exerted by the fluid displacement device. This way, the vapor cleaning solution will remain in the dry cleaning system, and it is therefore possible to re-use the vapor cleaning solution. For instance, the vapor may be stored temporarily for further use. It is also possible that the vapor cleaning solution is cleaned. Furthermore, it is possible that the vapor cleaning solution is liquefied.

In an embodiment, the step of operating the same fluid displacement device for depressurizing the wash tank comprises the step of compressing the vapor removed from the wash tank. This way, the pressure of the vapor, which was reduced during the depressurization of the wash tank, may be increased to a desired level. For instance, the pressure may be increased to a relatively constant level. For instance, the pressure may be increased to a constant value in the range of 700-900 psi, e.g. 725 psi, or 875 psi. Intermediate values are also possible. The constant value may be dependent on the value used throughout the rest of the system. Preferably, the pressure is increased to the pressure needed in the wash tank.

The method may comprise the steps of operating the fluid displacement device for pumping the cleaning solution in liquid form; and operating the fluid displacement device for compressing the cleaning solution in vapor form. The fluid displacement device may thus operate as a pump, for pumping liquids. The fluid displacement device may also operate as a compressor, for transferring and pressurizing vapors.

According to another aspect, a fluid displacement device is used in a dry cleaning system for washing articles in a wash tank employing a cleaning solution at a hyperatmospheric pressure, for depressurizing the wash tank. Instead of blowing off the contents of the wash tank, the contents are kept in the system, minimizing losses of material. Furthermore, a single device may be used for transferring fluid to the wash tank, and depressurizing the wash tank. Additionally, the use of such a fluid displacement device enables accurate and controlled depressurization of the wash tank. Furthermore, a relatively simple system is provided, since the fluid displacement device may be used in two operating modes.

According to yet another aspect, a fluid displacement device arranged for displacing and compressing fluids is used, in a dry cleaning system for washing articles employing a cleaning solution at a hyperatmospheric pressure. With this, a relatively simple dry cleaning system is obtained, since the fluid displacement device may be used in two operating modes.

The use of the fluid displacement device may comprise compressing the cleaning solution in vapor form. The fluid displacement device may also operate as a compressor, for transferring and pressurizing vapors. With this, the pressure of the vapor may be increased, whilst the pressure in the wash tank may effectively be decreased. The pressure throughout the rest of the dry cleaning system may remain at a constant level. Therefore, the use ensures that a relatively thermodynamic efficient system is obtained. The pressure may be a working pressure. The working pressure may be a constant value in the range of 700-900 psi, e.g. 725 psi or 875 psi. Different values are of course also possible. The fluid displacement device may be arranged for compressing vapor cleaning solution towards the working pressure.

DETAILED DESCRIPTION OF PREFERRED EMBODIMENTS

The present invention now will be described hereinafter with reference to the accompanying drawings, in which a preferred embodiment of the invention is shown. This invention may, however, be embodied in many different forms and should not be construed as limited to the embodiment set forth herein.

Figure 1:
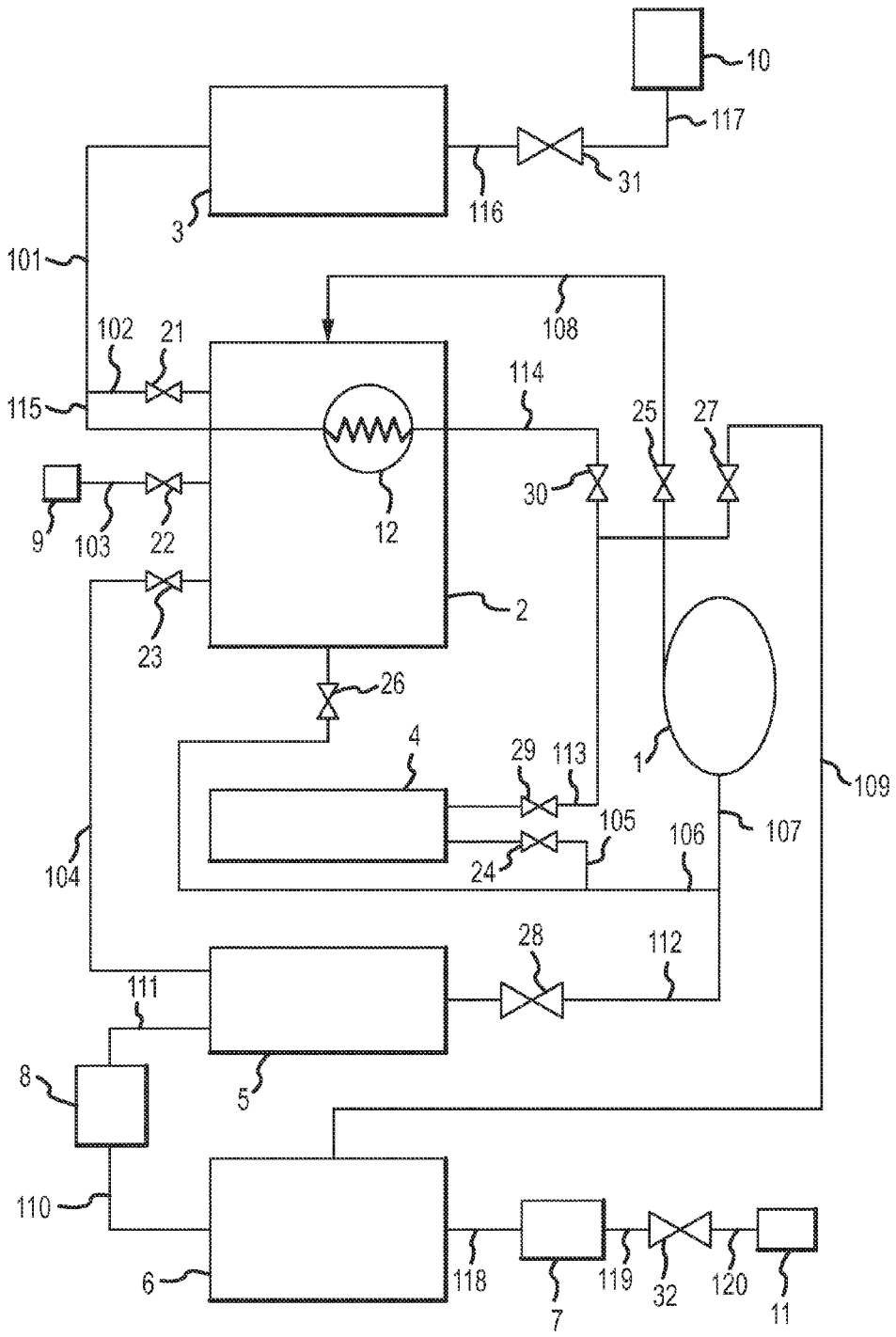
FIG. 1 illustrates a dry cleaning system employing a fluid displacement device according to the present invention.

Referring to FIG. 1, a carbon dioxide dry cleaning system is shown. The system comprises a wash tank 2 in which clothes and the like may be brought for washing, using a liquid/gaseous carbon dioxide cleaning solution. Besides the wash tank 2, the system comprises additional components that may be used to obtain a satisfactory washing result, as will be described next. The wash tank 2 is connected via lines 101, 102 to a purge tank 3, from which clean gaseous carbon dioxide may be brought into the wash tank 2. The wash tank is furthermore connected to an intermediate storage 4, in which liquid carbon dioxide cleaning solution may be temporarily stored during a washing cycle. The system further comprises a distillation 6 in which liquid carbon dioxide cleaning solution may be brought for cleaning. The cleaned solution may be transferred via lines 110, 111, to a central storage tank 5 for storing liquid carbon dioxide cleaning solution. The storage tank 5 is connected to the wash tank 2, such that clean liquid carbon dioxide may be brought into the wash tank 2 during a washing cycle. The system further comprises a fluid displacement device 1 for transferring the liquid/gaseous carbon dioxide cleaning solution throughout the system and its various components. The fluid displacement device 1 is arranged for both pumping liquid and vapor, and may also be used to compress the liquid and/or vapor, in order to keep the pressure at the pressure side of the fluid displacement device 1 at a desired level, as will be described later. Several valves 20-32 may be used to connect the different components to each other, as will be explained in further detail below.

In general, the wash cycle comprises the following steps: 0) Providing carbon dioxide cleaning solution, for instance to a central storage tank 5; 1) placing clothes to be cleaned inside the wash tank 2; 2) Charging carbon dioxide vapor into wash tank 2 to pressurize it; 3) transferring liquid cleaning solution, comprising liquid carbon dioxide as a solvent, from a general storage vessel (such as central storage tank 5) to the wash tank 2 via fluid displacement unit 1; 4) washing clothes in wash tank 2; 5) draining liquid cleaning solution from wash tank 2 to a general storage vessel; 6) depressurize the wash tank 2, e.g. by removing carbon dioxide vapor from the wash tank 2; and 7) removing clean clothes from wash tank 2.

Referring to FIG. 1, the general wash cycle will be described in more detail. At the beginning of the wash cycle, the wash tank 2 is at atmospheric pressure (14.7 psi). All valves 21-32 are in a closed position. Clothes to be cleaned may be placed inside the wash tank 2.

Next, the wash tank is pressurized. This may be done by connecting the central storage tank 5 to the wash tank 2. In the central storage tank 5, relatively clean cleaning solution, such as for example liquid and vapor carbon dioxide is stored at a pressure of approximately 725 psi. Higher pressures, such as 875 psi, are of course also possible. The central storage tank 5 is connected to the wash tank through line 104. Line 104 is provided in the part of the central storage tank 5 where vapor carbon dioxide accumulates. In this line, valve 23 is placed. By opening valve 23, an open connection between the storage tank 5 and the wash tank 2 is established. As a result, vapor carbon dioxide will transfer to the wash tank 2, and the pressure in the wash tank 2 will rise to approximately 725 psi. Of course, higher or lower pressures are possible, if the cleaning solution is stored at higher or lower pressures, respectively, inside the central storage tank 5. Afterwards, valve 23 is closed again.

In the next step, liquid cleaning solution is transferred to the wash tank 2. In an embodiment, liquid carbon dioxide is obtained from the central storage tank 5. The central storage tank 5 is connected to the wash tank 2 via lines 112 and 107, fluid displacement unit 1, and lines 108. Line 112 is connected to a part of the wash tank 2 where liquid carbon dioxide accumulates. In line 112, valve 28 is placed. In line 108, valve 25 is placed. By opening valves 28 and 25, liquid carbon dioxide may be transferred through fluid displacement unit 1 to the wash tank 2. The fluid displacement unit 1 then functions as a pump. Pressure in the wash tank may remain at approximately 725 psi.

The amount of liquid carbon dioxide transferred to the wash tank may be determined by the time the pumping unit 1 is activated. In an embodiment, the contents in the wash tank may be approximately equal to 50% vapor, and 50% liquid carbon dioxide. Other compositions are of course possible. After having transferred a sufficient amount of liquid carbon dioxide, valves 28 and 25 are closed again.

After bringing an amount of vapor and liquid carbon dioxide into the wash tank 2, the clothes to be cleaned may be washed. Washing may be exerted by continuously pumping cleaning solution, such as liquid carbon dioxide through the system. A bottom part of the wash tank 2 is connected to fluid displacement unit 1 through lines 106 and 107. Valve 26 is placed in line 106. As described before, the pump is connected to the wash tank 2 through line 108, having valve 25. By opening valves 26 and 28, and putting into operation pumping unit 1, liquid carbon dioxide from the wash tank may be re-circulated through the system. The fluid displacement unit 1 then functions as a pump. The clothes to be cleaned may be thoroughly washed this way. After washing, valves 26 and 28 are closed again.

After washing, the liquid carbon dioxide may be drained from the wash tank 2. In an embodiment, the liquid carbon dioxide is transferred back to the central storage tank 5. This way, the carbon dioxide may be re-used again. Preferably, the relatively dirty liquid carbon dioxide that is transferred to the central storage tank 5 is cleaned first. This may be done by transferring the liquid carbon dioxide to a cleaning device, such as distillation 6. The liquid carbon dioxide may be transferred from the vessel, through lines 106, 107, to the fluid displacement unit 1. From there, it may be transferred to distillation 6, through line 109 having valve 27. Transfer may be started by using fluid displacement unit 1, and opening valves 26 and 29. The fluid displacement unit 1 then functions as a pump. After transfer, valves 26 and 27 may be closed again. The relatively dirty liquid carbon dioxide will be distillated, and vapor carbon dioxide will transfer from the distillation 6 through lines 110, 111 to the central storage tank 5. The distillation 6 ensures that a relatively large part of the used carbon dioxide may be re-used again, by transferring distillated carbon dioxide to the central storage tank 5. The cleaned carbon dioxide may be a vapor. In an embodiment, a cooling unit 8 may be positioned in between the distillation 6 and the central storage tank 5. The cooling unit 8 ensures that vapor carbon dioxide is cooled down, such that liquid carbon dioxide is obtained, which then may be introduced into the central storage tank 5. Sludge obtained from the distillation process may be collected in a sludge collector 7, that is connected to the distillation 6 through line 118. Sludge may be removed from the system at point 11, through lines 119, 120, in which a valve 32 may be placed.

After having removed the liquid carbon dioxide, the remaining vapor carbon dioxide in the wash tank 2 may be removed. Pressure inside the wash tank 2 may still be relatively high, such as 725 psi. The wash tank 2 may be depressurized, using the fluid displacement unit 1. Depressurization may be exerted by transferring vapor carbon dioxide from the wash tank 2. The transfer of the vapor carbon dioxide will depressurize the wash tank 2. The vapor carbon dioxide may be transferred, for example, to the distillation 6 where the vapor will be cleaned and returned to the central storage tank 5. Transfer of the vapor carbon dioxide may be exerted by using fluid displacement unit 1. Preferably, the pressure of the vapor carbon dioxide is maintained at approximately 725 psi, to reduce pressure losses within the system. To this end, the fluid displacement unit 1 may function as a compressor in this step.

Finally, the wash tank 2 may be depressurized completely to atmospheric pressure, by opening valve 22 and blowing off the remaining gas in the vessel. Blowing off remaining gas in the vessel will lead to losses of gas. To prevent losses of gas, the remaining gas might be compressed as well. However, compressing the remaining gas in the vessel is relatively time consuming, making the process less efficient. Hence, an optimum between time efficiency and material losses is present. After depressurizing the wash tank 2, the clean clothes may be removed. Additionally, a new washing cycle may be started as described before.

The general washing cycle as described before may be expanded with additional steps to improve the washing result, preservation of carbon dioxide, and/or the energy efficiency. These additional steps will be described below.

To improve the washing result, it is possible that several washing steps are performed. For instance, a series of two washing steps may be used. Cleaning solution, such as liquid carbon dioxide may be brought into the wash tank 2, and clothes may be washed in a first washing step. After washing, the liquid carbon dioxide may be drained from the wash tank 2. Then, another (second) washing step may be performed, by further bringing carbon dioxide into the wash tank 2, washing clothes, and draining the liquid carbon dioxide once again. For the second washing step, liquid carbon dioxide may be obtained from the central storage tank 5.

The liquid carbon dioxide drained from the first washing step is relatively dirty. Therefore, it is preferred to clean this liquid carbon dioxide by transferring it to the distillation 6, as described before. However, the liquid carbon dioxide drained from the second washing step is relatively clean, and cleaning this liquid carbon dioxide is relatively energy consuming, as well as time consuming. Therefore, the liquid carbon dioxide drained is preferably transferred to an intermediate storage 4, where it is temporarily stored for alter use. The intermediate storage 4 is connected to pump 1 through line 113 having valve 29. Valve 26 in the wash tank-pump line 106, 107, is opened, together with valve 29. Fluid displacement unit 1 is put into operation, pumping liquid carbon dioxide from the wash tank 2 to the intermediate storage 4. The fluid displacement unit 1 then functions as a pump. The liquid carbon dioxide from the intermediate storage 4 may be used in a new washing cycle, when bringing liquid carbon dioxide into the wash tank 2. Thus, instead of using liquid carbon dioxide from the central storage tank 5, liquid carbon dioxide obtained from a previous washing cycle and stored in the intermediate storage 4 is used.

Before the step of pressurizing the wash tank 2 with vapor carbon dioxide, the air in the wash tank may be pre-conditioned. Preferably, nitrogen and oxygen are removed from the wash tank 2 in this pre-conditioning step. To this end, a purge tank 3 is connected to the wash tank 2 via lines 101, 102 and valve 21. In the purge tank 3, vapor carbon dioxide vapor is stored. The vapor carbon dioxide in the purge tank 3 has a pressure of approximately 70-230 psi. The pre-conditioning step is initiated by opening valve 21, and charging carbon dioxide vapor into the wash tank 2. The pressure in the wash tank 2 will increase to approximately 70-230 psi. Afterwards, valve 21 is closed again. Subsequently, valve 22 is opened after charging the wash tank 2 with vapor carbon dioxide. Air inside the wash tank 2 is blown off via line 103 to the atmosphere 9. With this, air, and more specifically nitrogen and oxygen are removed from the wash tank 2. As a result, the pressure in the wash tank 2 may be reduced to, for example, atmospheric pressure (14.7 psi). After depressurizing the wash tank 2, valve 22 is closed again. This step may be used to prepare the wash tank 2 for a following washing cycle, by (partially) cleaning the inside of the vessel 2.

After washing, the liquid carbon dioxide and the vapor carbon dioxide need to be drained from the wash tank 2. As stated before, the liquid carbon dioxide may be transferred from the wash tank to the intermediate storage, using fluid displacement unit 1. The vapor carbon dioxide remaining in the wash tank 2, may be removed in two subsequent steps. In the first step, vapor carbon dioxide is transferred from the wash tank 2 to the distillation 6, using the fluid displacement unit 1. The fluid displacement unit decreases the pressure inside the wash tank 2 towards atmospheric pressure. Preferably, the pressure in the wash tank 2 is reduced to approximately 115 psi. The fluid displacement unit 1 used in this step may then function as a compressor. The fluid displacement unit 1 is arranged for keeping the pressure of the medium transferred at approximately 725 psi. Hence, the vapor will enter the fluid displacement unit at a relatively low pressure, but will be transferred to the distillation 6 with a relatively high pressure. This ensures that the pressure side of the system remains at a relatively high pressure (i.e. approximately 725 psi), such that pressure losses and energy losses are prevented.

Once the pressure in the wash tank is reduced to approximately 115 psi, it is possible, in a second step, to transfer the remaining vapor carbon dioxide back to the purge tank 3. To this end, the fluid displacement unit 1 is connected to the purge tank 3 through lines 114, 115, and 101. In line 114 a valve 30 is placed. By opening valve 30 and 26, the remaining vapor carbon dioxide may be compressed and transferred towards the purge tank 3, using fluid displacement unit 1. The fluid displacement unit 1 thus functions as a compressor in this step. In the embodiment shown, a heat exchanger 12 is brought into contact with the wash tank 2. The heat exchanger is arranged for transferring heat from the medium (i.e. vapor carbon dioxide) passing through lines 114, 115, to the wash tank 2. Due to the compression action of the fluid displacement unit 1, the compressed vapor carbon dioxide will be heated, and this heat may be transferred to the wash tank 2, in order to pre-heat the wash tank 2 for a subsequent washing cycle. This step may be performed until the pressure inside the wash tank 2 is equal to approximately 30 psi. Then, all valves may be closed again. The wash tank 2 may be depressurized by blowing off air to the atmosphere by opening valve 22, as described before.

Figure 2A:
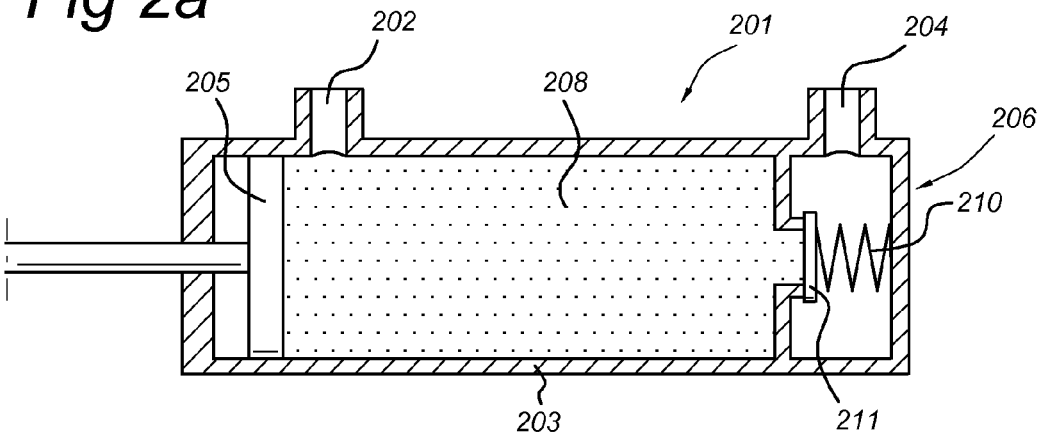
FIG. 2 illustrates a fluid displacement device according to the present invention.

FIG. 2*a* shows an embodiment of the fluid displacement device 201. The fluid displacement device 201 may be a positive-displacement device. The positive-displacement device may be a reciprocating device or a piston device that uses one or more pistons 205 driven by a crankshaft to pressurize fluid. The fluid displacement device 201 comprises an inlet 202 connected to a pumping chamber 208, in which a piston 205 is reciprocally movable. The pumping chamber 208 also comprises a discharge unit 206 connected to an outlet 204. The discharge unit may be a spring-loaded valve. The spring 210 exerts a force in the upstream direction, and ensures that the valve 211 is closed. A force in the opposite direction, i.e. the downstream direction, may open the valve 211, such that the pumping chamber 208 is in open connection with the outlet 204. The inlet 202 and discharge unit 206 are positioned at opposite ends of the pumping chamber. It is possible, however, to position the inlet and the discharge unit at one end of a cylindrical pumping chamber.

Figure 2B:
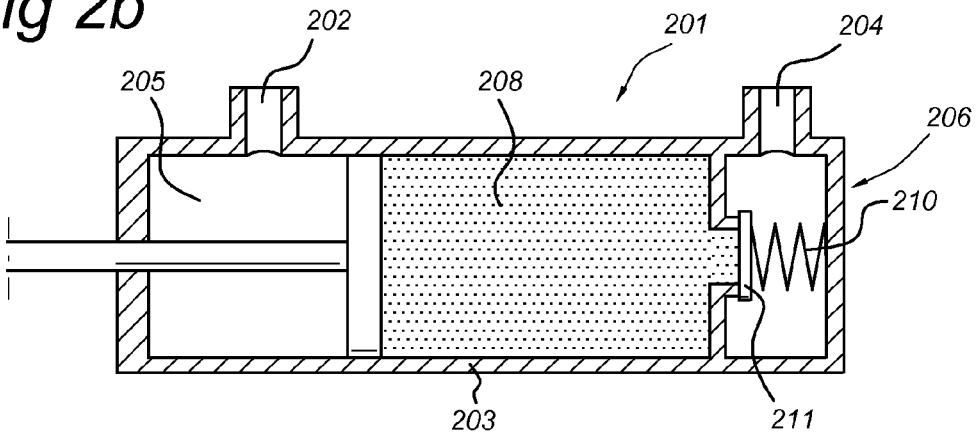
Figure 2C:
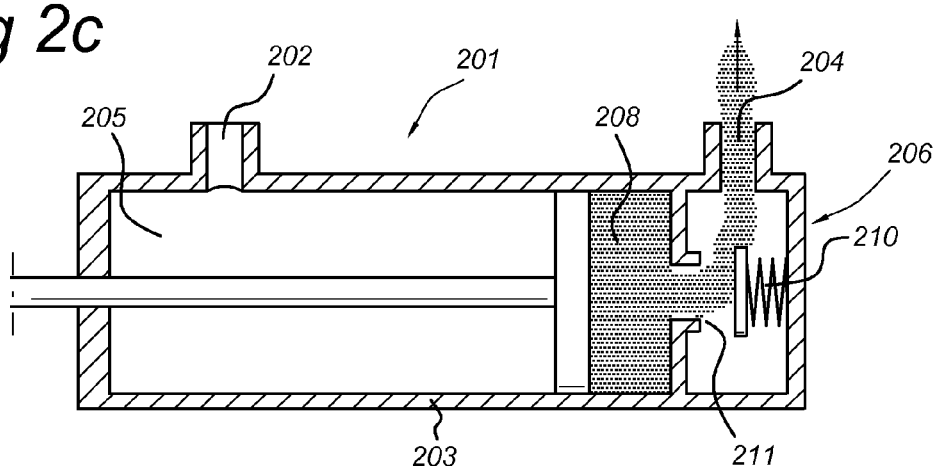

In FIGS. 2*a* to 2*c*, different stages in a working cycle of the fluid displacement device are shown. The piston 205 is movable between a first position, in which the volume of the pumping chamber 208 is maximal, towards a second position, in which the volume of the pumping chamber 208 is minimal. In FIG. 2*a*, the piston is in or near the first position. In FIG. 2*c*, the piston is in, or near the second position. Movement from the first position to the second position is called the compression stroke. Movement from the second position to the first position is called the expansion stroke.

As can be seen in FIG. 2*a*, the inlet 202 to the pumping chamber 208 is open when the piston is in the first position. Fluid may enter the pumping chamber 208 through the inlet 202. Referring to FIG. 2*b*, the inlet 202 is closed when the piston 205 moves in the compression stroke. Preferably, the inlet is closed right after the compression stroke has started. Further movement of the piston in the compression stroke pushes the fluid towards the discharge unit 206. The fluid is compressed during the compression stroke, and subsequently pushed through the discharge unit 206 when the pressure inside the pumping chamber 208 exceeds the pre-set pressure of the discharge unit 206. Since vapor is easily compressible, the fluid displacement device 201 and the discharge unit 206, such as a spring-loaded valve, may be used to compress the vapor. Thus, the discharge unit 206 ensures that the fluid, such as a gas or a vapor, may be compressed in order to increase the pressure of the fluid. When liquid is transferred by the piston 205 towards the discharge unit 206, the force exerted by the liquid is large enough to open the discharge unit 206, and the liquid may transfer to the outlet 204. Thus the fluid may be easily pumped by the fluid displacement device. After having completed the compression stroke, the piston starts the expansion stroke. BY moving he piston towards the first position, the pressure inside the pumping chamber 208 will decrease. As a result, the discharge unit 206 is closed. The pumping chamber 208 is now completely closed, such that movement of the piston increases the volume, and subsequently lowers the pressure. When the piston reaches the first position, the pressure in the pumping chamber is lower than the pressure of the fluid near the inlet 202 of the fluid displacement device 201. Hence, the fluid, either gas or liquid, is sucked inside the pumping chamber 208, after which another compression stroke may take place. Hence, the fluid displacement device is able to function as a pumping/compressing unit, arranged for both pumping and compressing the cleaning solution.

It is possible that additional pumping chambers are provided to the fluid displacement device, each having a respective piston. Additional discharge valves may be provided.

In another embodiment a further valve, in particular a one-way valve is present upstream from the pumping chamber.

In an embodiment the fluid inlet into the pumping chamber 208 is provided in the piston, in particular through the piston axle.

In an embodiment the one way valve upstream from the pumping chamber 208 is provided in the piston.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A dry cleaning system arranged for washing articles employing a cleaning solution, said cleaning solution comprising a liquid and a vapor, said system comprising:

a wash tank for washing an article to be washed with said cleaning solution at hyperatmospheric pressure;

a central storage tank for storing said cleaning solution, wherein said central storage tank is closeably connected to said wash tank;

a cleaning device connected to the wash tank for cleaning the cleaning solution; and a single fluid displacement device being a pumping and compressing unit connected through a wash tank-pump line to said wash tank for transfer of cleaning solution from the wash tank to the fluid displacement device and through a further line for transfer of liquid from the fluid displacement device to the wash tank wherein the wash-tank line and the further line are each closeable by a respective valve and said single fluid displacement device being arranged for:

transferring said cleaning solution in liquid form through said dry cleaning system in a first operational mode of a wash cycle;

continuously cleaning the cleaning solution in liquid form by transferring the cleaning solution in liquid form through the cleaning device during the first operational mode of the wash cycle; and reducing the pressure in said wash tank toward atmospheric pressure in a second operational mode of the wash cycle, after removal of the liquid cleaning solution from the wash tank to the central storage tank, by removing the vapor from the wash tank by means of compressing the removed vapor, wherein the fluid displacement device is a positive-displacement device, being a reciprocating pump/compressor device or a piston device to pressurize fluid, arranged for transferring liquid and vapor fluid, and for compressing vapor fluid.

2. The dry cleaning system according to claim 1, wherein said fluid displacement device is arranged for compressing vapor removed from said wash tank.

3. The dry cleaning system according to claim 2 wherein the fluid displacement device comprises a pumping chamber having an outlet and a discharge unit connected to the pumping chamber outlet opening and arranged for closing the pumping chamber outlet opening when a pressure inside the pumping chamber is less than a pre-set pressure.

4. The dry cleaning system according to claim 3, wherein the fluid displacement device comprises an inlet connected to the pumping chamber, in which a piston is reciprocally movable, wherein the pumping chamber comprises a pumping chamber inlet opening connected to the inlet and provided near one end of the pumping chamber, and a pumping chamber outlet opening connected to the outlet and provided near an opposite end of the pumping chamber, and wherein the piston is arranged for alternately opening and closing the pumping chamber inlet opening during movement of the piston.

5. The dry cleaning system according to claim 3, wherein the discharge unit is a spring-loaded valve.

6. The dry cleaning system according to claim 3, wherein the fluid displacement device comprises an additional pumping chamber connected to the inlet and the outlet.

7. The dry cleaning system according to claim 6, wherein the fluid displacement comprises three pumping chambers, connected to the inlet and the outlet.

8. The dry cleaning system according to claim 1, further comprising an intermediate storage tank connected to said wash tank for temporarily storing said cleaning solution, wherein said fluid displacement device is arranged for transferring said cleaning solution between said intermediate storage tank and said wash tank.

9. The dry cleaning system according to claim 1, wherein the cleaning device is a distillation unit.

10. The dry cleaning system according to claim 1, wherein said fluid displacement device is arranged for compressing said vapor and transferring said compressed vapor to said cleaning device for cleaning the cleaning solution in vapor form during the second operational mode of the wash cycle.

11. The dry cleaning system according to claim 10, wherein the cleaning device is a distillation unit.

12. The dry cleaning system according to claim 11, wherein said distillation unit is connected to said central storage tank for returning cleaned cleaning solution to said central storage tank.

13. The dry cleaning system according to claim 12, wherein the system comprises a cooling unit arranged for bringing said cleaned and returned cleaning solution into liquid form.

14. The dry cleaning system according to claim 1, wherein said cleaning solution comprises liquid carbon dioxide.

15. The dry cleaning system according to claim 1, further comprising a purging unit for cleaning said wash tank.

16. The dry cleaning system according to claim 15, wherein the purging unit comprises a purge tank for storing a purging fluid, wherein said purge tank may be brought into fluid communication with said wash tank, and wherein said purging fluid is arranged for cleaning said wash tank.

17. The dry cleaning system according to claim 16, wherein the purging fluid is vapor carbon dioxide.

18. The dry cleaning system according to claim 1, wherein the central storage stores vapor cleaning solution and wherein said central storage is connected to said wash tank for transferring vapor cleaning solution to said wash tank.

* * * * *